US007096930B2

(12) United States Patent
Nobuta et al.

(10) Patent No.: US 7,096,930 B2
(45) Date of Patent: Aug. 29, 2006

(54) HEAT EXCHANGER FOR REFRIGERANT CYCLE

(75) Inventors: Tetsuji Nobuta, Kariya (JP); Naoki Sugimoto, Anjo (JP); Ryouichi Sanada, Obu (JP); Tatsuhiko Nishino, Kariya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/895,295

(22) Filed: Jul. 20, 2004

(65) Prior Publication Data

US 2005/0039893 A1 Feb. 24, 2005

(30) Foreign Application Priority Data

Jul. 22, 2003 (JP) ..... 2003-277588

(51) Int. Cl.
*F28D 1/06* (2006.01)

(52) U.S. Cl. ..... 165/132; 165/153; 165/174

(58) Field of Classification Search ..... 165/132, 165/152, 153, 172–175
See application file for complete search history.

(56) References Cited

U.S. PATENT DOCUMENTS 5,186,249 A * 2/1993 Bhatti et al. ..... 165/174
6,237,677 B1 5/2001 Kent et al.
6,250,103 B1 * 6/2001 Watanabe et al. ..... 62/509
6,874,569 B1 * 4/2005 Gawthrop et al. ..... 165/174
2001/0010263 A1 * 8/2001 Ichiyanagi ..... 165/178

FOREIGN PATENT DOCUMENTS

JP 2002-130866 5/2002

* cited by examiner

*Primary Examiner*—Teresa J. Walberg
(74) *Attorney, Agent, or Firm*—Harness, Dickey & Pierce PLC

(57) ABSTRACT

In a condenser of a refrigerant cycle, a throttle portion is provided at a predetermined position in one of first and second header tanks to decompress refrigerant while refrigerant meanderingly flows within the one of the first and second header tanks. Therefore, refrigerant from the throttle portion is sufficiently mixed with refrigerant directly flowing from tubes into a downstream space of the throttle portion in the one of the first and second header tanks. Accordingly, even when gas refrigerant is directly introduced from a part of the tubes directly into the lower downstream space, the gas refrigerant can be effectively heat-exchanged with the refrigerant flowing from the throttle portion. As a result, it can restrict refrigerant from being discharged from the condenser in a gas-liquid two-phase state.

19 Claims, 8 Drawing Sheets

HEAT EXCHANGER FOR REFRIGERANT CYCLE

CROSS REFERENCE TO RELATED APPLICATION

This application is based on Japanese Patent Application No. 2003-277588 filed on Jul. 22, 2003, the disclosure of which is incorporated herein by reference.

FIELD OF THE INVENTION

The present invention relates to a heat exchanger for radiating heat, and is suitably applied to a high-pressure heat exchanger (e.g., refrigerant radiator, refrigerant condenser) of a vapor compression refrigerant cycle.

BACKGROUND OF THE INVENTION

In a multi-flow heat exchanger 100 (condenser) shown in FIG. 8, refrigerant flowing into a first header tank 101*b* is supplied to plural tubes 101*a* to be distributed into each of the tubes 101*a*, and condensed liquid refrigerant flowing out of the tubes 101 is collected into a second header tank 101*c*. However, in this case, it is difficult to uniformly distribute the refrigerant from the first header tank 101*b* into the tubes 101*a*. When a distribution performance of refrigerant flowing into the tubes 101*a* is deteriorated, radiating performance of the heat exchanger 100 cannot be sufficiently improved.

To overcome this problem, in a condenser described JP-2002-130866, an orifice throttle is provided in a longitudinal middle portion of the second header tank 101*c* to decompress refrigerant flowing in the second header tank 1*d*, so that it can restrict a refrigerant amount flowing into the lower side tubes 101 separated from a refrigerant inlet from being reduced. However, in this condenser, because the orifice throttle is formed in a plate member within a header tank, refrigerant from the orifice throttle flows to a downstream space mainly in the longitudinal direction of the header tank.

In an actual condenser of a refrigerant cycle, gas refrigerant introduced into the condenser 100 is not entirely condensed in the tubes 101*a*, and gas refrigerant may be discharged from a part of the tubes 101*a*. In this case, gas refrigerant more than a necessary, degree is stored in a receiver, and a liquid refrigerant amount more than a necessary amount flows into an evaporator from the receiver. Accordingly, liquid refrigerant may be discharged from the evaporator to a compressor, and high-pressure equipments including the compressor may be damaged.

In contrast, in a vapor compression refrigerant cycle without the receiver, gas-liquid mixed refrigerant flows into an evaporator from the condenser, and heat-absorbing capacity of refrigerant in the evaporator is decreased.

SUMMARY OF THE INVENTION

In view of the above-described problems, it is an object of the present invention to provide a heat exchanger (e.g., a refrigerant condenser, a refrigerant radiator) of a refrigerant cycle, which restricts refrigerant from flowing out of the heat exchanger in a gas-liquid mixing state.

According to the present invention, a heat exchanger for a refrigerant cycle includes a plurality of tubes in which refrigerant flows in a tube longitudinal direction, a first header tank extending in a direction perpendicular to the tube longitudinal direction to communicate with the tubes at one end side of each tube in the tube longitudinal direction, a second header tank extending in a direction perpendicular to the longitudinal direction of the tubes to communicate with the tubes at the other end side of each tube in the tube longitudinal direction, and a throttle portion for decompressing refrigerant. In the heat exchanger, the throttle portion for decompressing refrigerant is provided at a predetermined position of one of the first and second header tanks to meanderingly flow the refrigerant within the one of the first and second header tanks in a refrigerant flow of a longitudinal direction of the first and second header tanks.

Because the refrigerant flow meanderings in the one of the first and second header tanks by the throttle portion, the refrigerant from the throttle portion flows into a downstream space of the throttle portion from a direction crossing with the longitudinal direction of the one of the first and second header tanks. Therefore, the refrigerant flowing from the throttle portion into the downstream space collides with refrigerant directly flowing from the tubes to the downstream space of the throttle portion to press the refrigerant directly flowing from the tubes to the side of the tubes. Accordingly, refrigerant is sufficiently mixed in the downstream space of the throttle portion. Thus, even if gas refrigerant is directly discharged from a part of the tubes into the downstream space of the throttle portion, the gas refrigerant can be heat exchanged with the liquid refrigerant in the downstream space of the throttle portion. As a result, it can restrict gas refrigerant from being discharged from the heat exchanger (condenser).

Preferably, the first header tank has a refrigerant inlet from which refrigerant is introduced from an exterior, and the throttle portion is provided in the second header tank. For example, the throttle portion is provided in the second header tank to turn once a flow of the refrigerant flowing in the second header tank to an outside more than an inner surface and further turn the turned flow of the refrigerant to an inside of the second header tank.

More preferably, the second header tank includes a tank portion that is connected to the tubes and has a hole portion at a side opposite to the tubes, and the throttle portion is arranged at a position where the hole portion is provided. In this case, the throttle portion is constructed with at least a turning plate having a flat surface crossing with a longitudinal direction of the second header tank, and a cover member for closing the hole portion. For example, the turning plate is disposed in the second header tank to continuously extend from an inner surface of a wall portion of the second header tank, connected to the tubes, to at least an inner surface of a wall portion of the second header tank having the hole portion. Alternatively, the turning plate extends to a position around the inner surface of the wall portion of the second header tank having the hole portion.

The present invention can be applied to a heat exchanger integrated with a receiver of a refrigerant cycle, for separating refrigerant from the heat exchanger into gas refrigerant and liquid refrigerant. In this case, the second header tank is integrated with the receiver, and a part of the receiver is used as the cover member. For example, the cover member is connected to the hole portion of the second header tank through a connection member that is arranged between the second header tank and the cover member.

Preferably, the first and second header tanks are arranged to extend in a vertical direction, and the throttle portion is provided in the second header tank at a position higher than a bottom end of the second header tank by a predetermined dimension. Further, the predetermined dimension is in a range of 1/20–1/3 of a height dimension of the second header tank. For example, in this case, the first header tank has a refrigerant inlet at a top end side, from which refrigerant is introduced from an exterior, the second header tank has a refrigerant outlet at a bottom end side of the second header tank, and the first header tank and the second header tank are connected to the tubes such that refrigerant introduced into the first header tank passes through all the tubes and is introduced into the second header tank.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS (First Embodiment)

Figure 1:
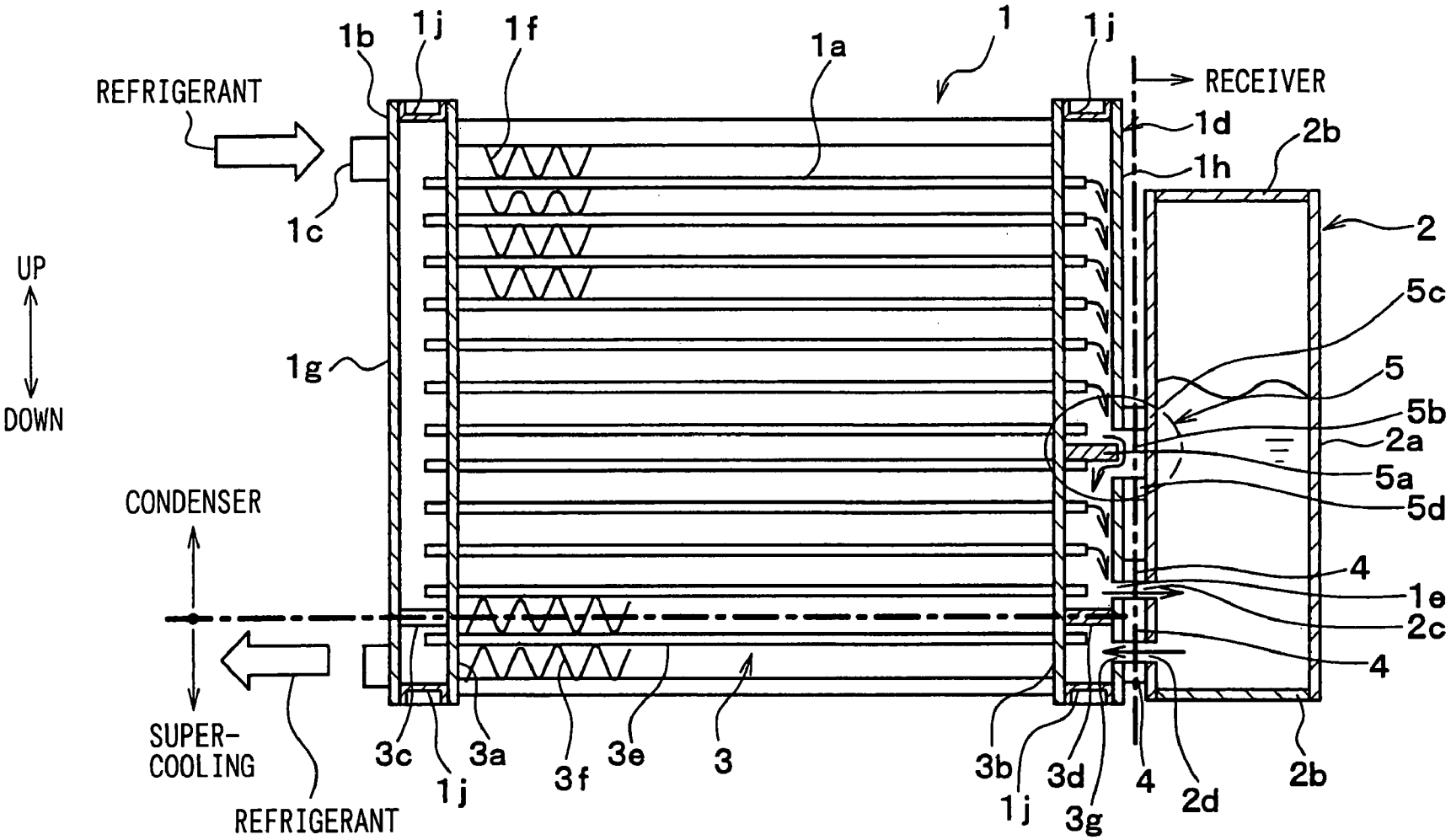
FIG. 1 is a schematic sectional view showing a receiver-integrated condensation device according to a first embodiment of the present invention.

In the first embodiment, the present invention is typically applied to a condenser (high-pressure heat exchanger, refrigerant radiator) of a vapor compression refrigerant cycle used for a vehicle air conditioner. FIG. 1 shows a receiver-integrated condensation device in which a receiver 2 and a super-cooling device 3 are integrated to a condenser 1. The vapor compression refrigerant cycle transfers heat from a low-temperature side to a high-temperature side. The vapor compression refrigerant cycle is constructed with a compressor, the receiver-integrated condensation device, a decompression device and an evaporator. The compressor compresses refrigerant and discharges the compressed refrigerant to the condenser 1. The refrigerant compressed in the compressor is cooled in the receiver-integrated condensation device, and the cooled refrigerant is decompressed by the decompression device. The low-pressure refrigerant decompressed in the decompression device is evaporated in an evaporator so that a cooling capacity can be obtained.

In the receiver-integrated condensation device, refrigerant discharged from the compressor is cooled and condensed in the condenser 1, and cooled refrigerant flows into the receiver 2 to be separated into gas refrigerant and liquid refrigerant. The liquid refrigerant separated in the receiver 2 flows into the super-cooling device 3 to be super-cooled in the super-cooling device 3. In this embodiment, a surplus refrigerant in the vapor compression refrigerant cycle is stored in the receiver 2 as liquid refrigerant, and the liquid refrigerant flowing out of the receiver 2 is supplied to the super-cooling device 3 to be super-cooled.

The receiver 2 is connected to a refrigerant outlet side of the condenser 1, the super-cooling device 3 is connected to a liquid refrigerant outlet of the receiver 2, and the decompression device is connected to a refrigerant outlet of the super-cooling device 3.

Next, a structure of the receiver-integrated condensation device will be now described in detail. In FIG. 1, the condenser 1, the receiver 2 and the super-cooling device 3 are roughly separated by the chain lines. That is, the left upper part in FIG. 1 indicates the condenser 1, the right part in FIG. 1 indicates the receiver 2, and the left lower part in FIG. 1 indicates the super-cooling device 3.

The condenser 1 includes plural tubes 1*a* in which refrigerant flows. Each of the tubes 1*a* has a flat shape and extends approximately in a horizontal direction. The tubes 1*a* are arranged in a vertical direction in parallel with each other such that its longitudinal direction is positioned approximately in the horizontal direction.

The condenser 1 further includes a first header tank 1*b* extending in a direction (e.g., vertical direction) perpendicular to the longitudinal direction of the tubes 1*a* to communicate with one side ends of the tubes 1*a*, and a second header tank 1*d* extending in the direction (e.g., vertical direction) perpendicular to the longitudinal direction of the tubes 1*a* to communicate with the other side ends of the tubes 1*a*. The first header tank 1*b* is formed into a cylindrical shape, and has a refrigerant inlet 1*c* at one end side (e.g., upper end side in this embodiment) in a longitudinal direction of the first header tank 1*b*. A refrigerant discharge side of the compressor is coupled to the refrigerant inlet 1*c* so that the refrigerant discharged from the compressor is introduced into the condenser 1 from the refrigerant inlet 1*c*.

The second header tank 1*d* has a refrigerant outlet 1*e* at the other end side (e.g., lower end side in this embodiment) in the longitudinal direction of the second header tank 1*d*.

In the first embodiment, the first header tank 1*b* of the condenser 1 is integrated with a header tank 3*a* of the super-cooling device 3 to construct a first integrated tank portion extending in the longitudinal direction of the first header tank 1*b*. The first integrated tank portion is separated by a separator 3*c* into the first header tank 1*b* of the condenser 1 and the header tank 3*a* of the super-cooling device 3.

Similarly, the second header tank 1*d* of the condenser 1 is integrated with a header tank 3*b* of the super-cooling device 3 to construct a second integrated tank portion extending in the longitudinal direction of the second header tank 1*d*. The second integrated tank portion is separated by a separator 3*d* into the second header tank 1*d* of the condenser 1 and the header tank 3*b* of the super-cooling device 3.

Accordingly, in the first embodiment, the first integrated tank portion including the first header tank 1*b* of the condenser 1 and the header tank 3*a* of the super-cooling device 3 is constructed with a tank portion 1*g* formed into a cylinder or a multi-angular piping, and caps 1*j* for closing longitudinal ends of the tank portion 1*g*. Similarly, the second integrated tank portion including the second header tank 1*d* and the header tank 3*b* is constructed with a tank portion 1*h* formed into a cylinder or a multi-angular piping, and caps 1*j* for closing longitudinal ends of the tank portion 1*g*.

The super-cooling device 3 includes at least a tube 3*e* that is arranged in parallel to the tubes 1*a* to be connected to both the header tanks 3*a*, 3*b*. Fins 1*f*, 3*f* are connected to flat surfaces of the tubes 3*e* and the tube 1*a*, to increase a heat exchanging area with air and to facilitate the heat exchange between air and refrigerant. In this embodiment, corrugated fins having wave shapes are used as the fins 1*f*, 3*f*.

The receiver 2 includes a tank portion 2*a*, and caps 2*b* for closing longitudinal ends of the tank portion 2*a*. A connection plate 4 is disposed between the receiver 2 and the second integrated tank portion, such that a refrigerant inlet 2*c* of the receiver 2 is connected to the refrigerant outlet 1*e* of the condenser 1 through the connection plate 4, and a refrigerant outlet 2*d* of the receiver 2 is connected to a refrigerant inlet 3*g* provided in the header tank 3*b* through the connection plate 4.

Figure 2A:
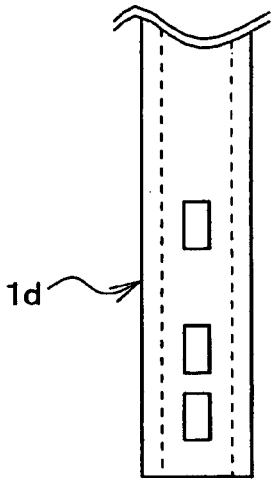
FIG. 2A–2C are side views showing a part of a second header tank, connection plates and a receiver of the receiver-integrated condensation device according to the first embodiment.
Figure 2B:
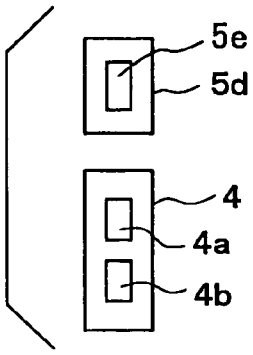
Figure 2C:
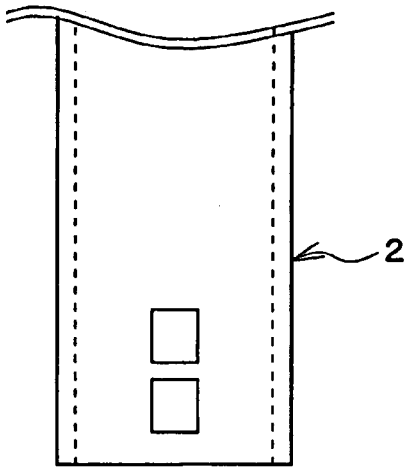

As shown in FIG. 2, the connection plate 4 is a plate member having refrigerant passages 4*a*, 4*b*. Through the refrigerant passage 4*a*, the refrigerant inlet 2*c* of the receiver 2 communicates with the refrigerant outlet 1*e* of the condenser 1. Further, through the refrigerant passage 4*b*, the refrigerant outlet 2*d* of the receiver 2 communicates with the refrigerant inlet 3*g* provided in the header tank 3*b* of the super-cooling device 3.

A throttle portion 5 is provided in the second header tank 1*d* at a portion lower than a longitudinal center portion of the second header tank 1*d*, so that refrigerant meanderingly flows in the second header tank 1*d* in its longitudinal direction by the throttle portion 5 while being decompressed by the throttle portion 5.

In this embodiment, the throttle portion 5 is constructed with a turning plate 5*a* having a flat surface crossing with the longitudinal direction of the second header tank 1*d*, and a cover member 5*c* for closing a hole portion 5*b* that is provided in the tank portion 1*h* of the second header tank 1*d* at a position corresponding to the turning plate 5*a*.

A connection plate 5*d* shown in FIG. 2B is disposed to connect the hole portion 5*b* of the second header tank 1*d* and the cover member 5*c*. The connection plate 5*d* has a communication hole 5*e* communicating with the hole portion 5*b* of the second header tank 1*d*. Therefore, an insulation space can be formed by the hole portion 5*b* and the communication hole 5*e*, between the receiver 2 and the second header tank 1*d*, and a part of the tank portion 2*a* of the receiver 2 is used as the cover member 5*c*. Further, as shown in FIG. 1, the turning plate 5*a* extends approximately horizontally from an inner surface of the second header tank 1*d* adjacent to the tubes 1*a*, toward the receiver 2 to a position more than an inner surface of a wall portion of the second header tank 1*d* adjacent to the receiver 2.

Accordingly, refrigerant flowing into an upper portion of the second header tank 1*d* upper than the turning plate 5*a* flows into an opening portion of the throttle portion 5 while being turned toward the receiver 2 more than the inner surface of the wall portion of the second header tank 1*d*. Thereafter, the refrigerant after being turned in the throttle portion 5 flows into a lower portion of the second header tank 1*d* lower than the turning plate 5*a* toward an inner side. Thus, refrigerant is decompressed in the throttle portion 5 while meanderingly flows in the second header tank 1*d* from the upper portion to the lower portion.

In the first embodiment, all members of the condenser 1, such as the tubes 1*a*, the receiver 2 and the super-cooling device 3 are made of an aluminum alloy, and are integrally bonded by brazing. In this brazing, a bonding is performed by using a brazing material or a solder without melting a base metal, as described in "CONNECTION/BONDING TECHNIQUE" (Tokyo Electrical Publication). Generally, a bonding performed by using a melting material having a meting point equal to or higher than 450° C. is called as the brazing, and the melting material used in this bonding is called as the brazing material. In contrast, a bonding performed by using a melting material having a meting point lower than 450° C. is called as the soldering, and the melting material used in this bonding is called as the solder.

According to the first embodiment of the present invention, gas refrigerant flowing into the first header tank 1*b* from the refrigerant inlet 1*c* is supplied to each tube 1*a*, and is cooled and condensed by performing heat exchange with air passing through the condenser 1. Refrigerant (liquid refrigerant) flowing out of the tubes 1*a* is collected to the second header tank 1*d*, and flows into the receiver 2. Then, the liquid refrigerant from the receiver 2 is supplied to the super-cooling device 3.

In this embodiment, the second header tank 1*d* is separated into a first portion (i.e., upper portion in the first embodiment) at one longitudinal end side of the second header tank 1*d*, and a second portion (i.e., lower portion in the first embodiment) at the other longitudinal end side of the second header tank 1*d*. The refrigerant flowing into the first portion of the second header tank 1*d* from the tubes 1*a* is decompressed in the throttle portion 5. Therefore, it can prevent the refrigerant amount flowing through the tubes 1*a* of the condenser 1 at the lower side from being decreased.

Further, in the first embodiment, refrigerant meanderingly flows in the second header tank 1*d* by the throttle portion 5. Specifically, the refrigerant flows from the first portion (upper portion) of the second header tank into the opening portion of the throttle portion 5 in a direction crossing with the longitudinal direction of the second header tank 1*d*, and flows from the opening portion of the throttle portion 5 to the second portion (lower portion) to be turned mainly in a direction crossing with the longitudinal direction of the second header tank. Accordingly, refrigerant passing the throttle portion 5 flows toward the tubes 1*a* in the lower portion of the second header tank 1*d*, and collides with refrigerant flowing directly from the tubes la into the lower portion of the second header tank 1*d*.

Therefore, refrigerant from the throttle portion 5 into the lower portion of the second header tank 1*d* and refrigerant from the tubes 1*a* directly to the lower portion of the second header tank 1*d* are sufficiently mixed to effectively perform heat exchange therebetween. Accordingly, even if gas refrigerant flows out of a part of the tubes 1*a* directly to the lower portion of the second header tank 1*d*, the gas refrigerant is heat exchanged with the liquid refrigerant from the throttle portion 5. As a result, refrigerant flowing out of the condenser 1 becomes in a saturation liquid refrigerant state or a super-cooling liquid phase state.

If an orifice is simply provided in a partition plate in the second header tank 1*d* to flow refrigerant from the upper portion to the lower portion of the second header tank 1*d* approximately linearly, the refrigerant from the orifice cannot be sufficiently mixed with the refrigerant directly flowing from the tubes 1*a* to the lower portion of the second header tank 1*d*, and gas refrigerant may be discharged from the condenser 1. However, according to the first embodiment, because the throttle portion 5 is provided so that refrigerant meanderingly flows from the upper portion of the second header tank 1*d* to the lower portion of the second header tank 1*d* while being decompressed in the throttle portion 5. Accordingly, it can restrict gas refrigerant from being discharged from the condenser 1.

When the arrangement position of the throttle portion 5 is excessively close to the longitudinal ends of the second header tank 1*d*, the effect of the throttle portion 5 is not improved. Accordingly, in this embodiment, the throttle portion 5 is arranged to be separated from the bottom end (i.e., the position of the separator 3*d*) of the second header tank 1*d* by a height dimension that is about 1/20–1/3 of a longitudinal dimension of the second header tank 1*d*. In this case, the mixing performance between the refrigerant from the throttle portion 5 to the lower portion of the second header tank 1*d* and the refrigerant directly from the tubes 1*a* to the lower portion of the second header tank 1*d* can be improved.

Further, in the first embodiment, because the throttle portion 5 can be readily constructed by the turning plate 5*a* without an orifice, it can prevent a throttle opening from being closed in brazing or bonding.

(Second Embodiment)

Figure 3:
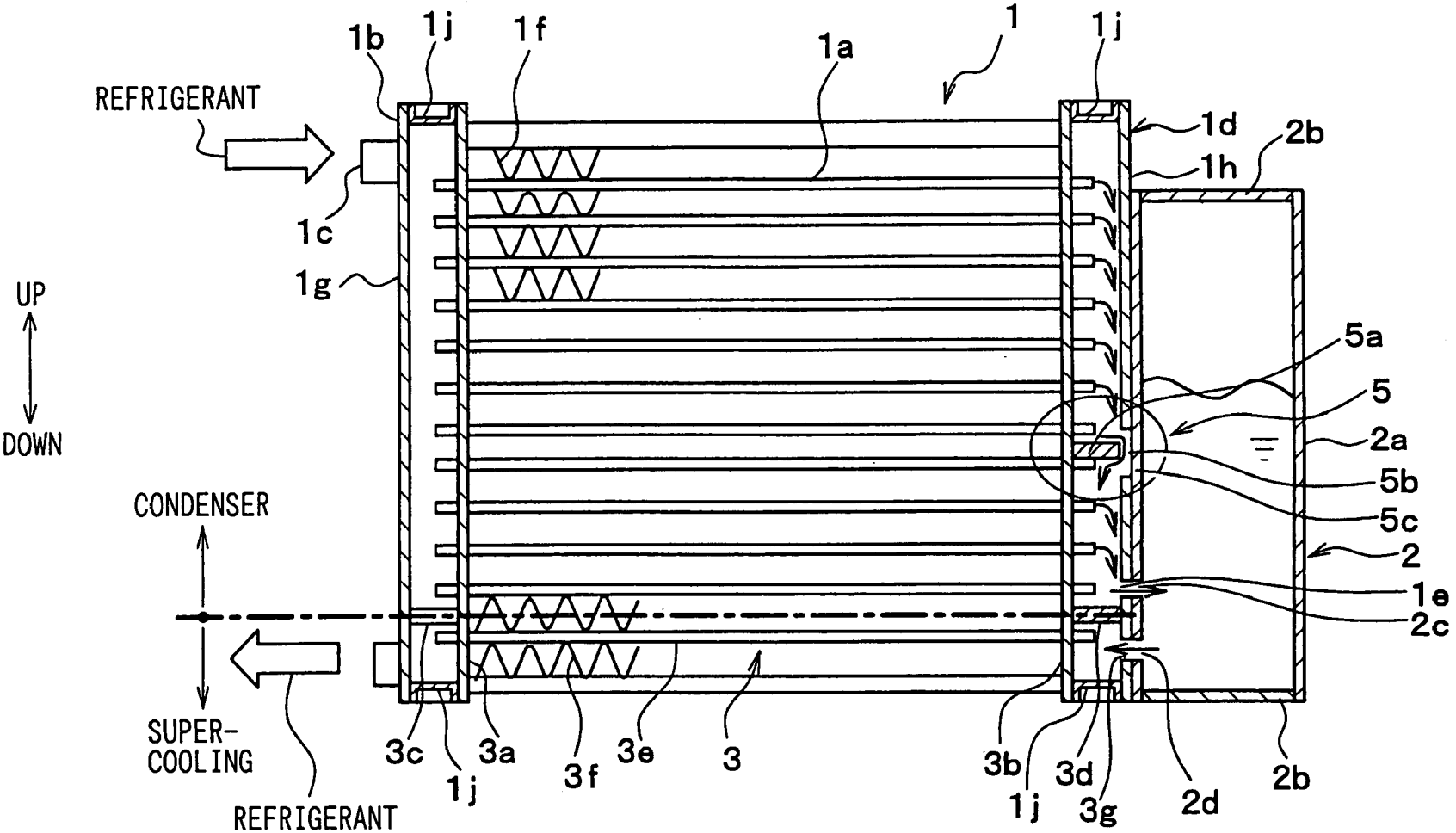
FIG. 3 is a schematic sectional view showing a receiver-integrated condensation device according to a second embodiment of the present invention.

The second embodiment of the present invention will be now described with reference to FIG. 3. In the second embodiment, as shown in FIG. 3, the receiver 2 is directly bonded to the second header tank 1*d* without using the connection plate 4 and the connection plate 5*d*. In this case, the throttle portion 5 is constructed with the turning plate 5*a*, the hole portion 5*b* of the second header tank 1*d* and a cover member 5*c* that is a part of a wall surface of the receiver 2. In the second embodiment, the turning plate 5*a* extends approximately horizontally from the inner surface of the second header tank 1*d* on the side of the tubes 1*a*, to a position around the inner surface of the second header tank 1*d* on the side of the receiver 2.

In the second embodiment, a wall thickness of the tank portion 1*h* can be set thicker than that of the first embodiment. In this case, the opening portion of the throttle portion 5 can be readily formed. In the second embodiment, the other parts are similar to those of the above-described first embodiment.

(Third Embodiment)

In the above-described first and second embodiments, a partition plate for entirely partitioning an inner space in the first header tank 1*b* or the second header tank 1*d* is not provided, and the condenser 1 is a full-pass type heat exchanger. In this case, refrigerant introduced from the first header tank 1*b* passes through the whole tubes 1*a* to flow into the second header tank 1*d*, and is discharged from the refrigerant outlet 1*e* provided at a longitudinal end side of the second header tank 1*d*.

Figure 4:
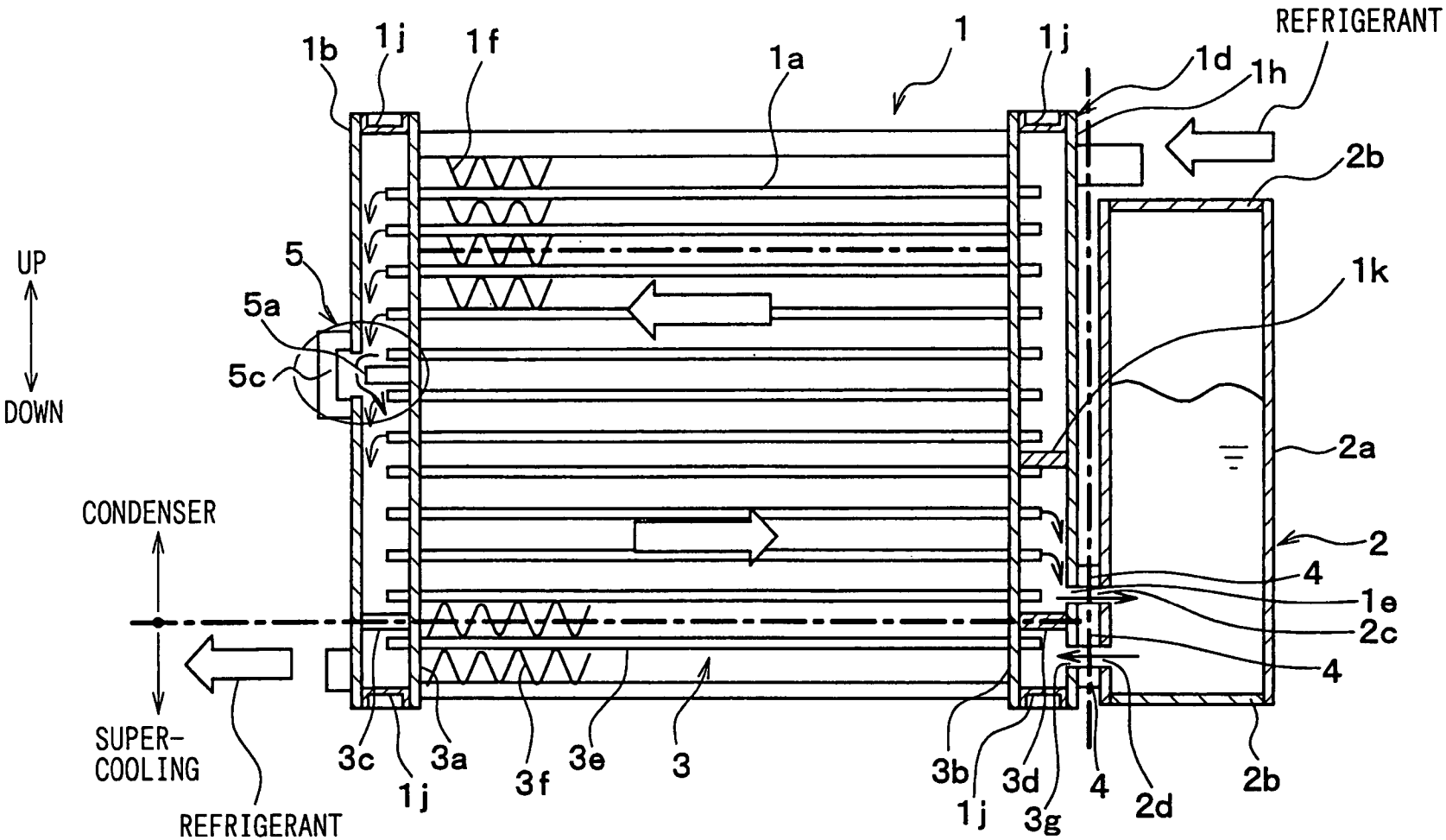
FIG. 4 is a schematic sectional view showing a receiver-integrated condensation device according to a third embodiment of the present invention.

However, in the third embodiment, as shown in FIG. 4, a partition plate 1*k* is disposed in the second header tank 1*d* to entirely partition the inner space of the second header tank id into an upper space and a lower space. Further, the throttle portion 5 is provided in the first header tank 1*b* at a height position higher than an arrangement position of the partition plate 1*k*. Therefore, in the third embodiment, refrigerant flows through the condenser 1 to be U-turned.

Specifically, refrigerant flowing into the upper space of the second header tank 1*d* from the refrigerant inlet 1*c* provided in the second header tank 1*d* passes through the upper tubes 1*a* upper than the partition plate 1*k*, and flows into the first header tank 1*b*. The refrigerant flowing into the upper portion of the first header tank 1*b* upper than the throttle portion 5 passes through the opening portion of the throttle portion 5 meanderingly, and flows into the lower portion of the first header tank 1*b* from the throttle portion 5. Then, the refrigerant in the lower portion of the first header tank 1*b* passes through the tubes 1*a* under the partition plate 1*k* to flow into the lower space of the second header tank 1*k* and is discharged to the receiver 2 through the refrigerant outlet 1*e*.

In the third embodiment, the throttle portion 5 is provided in the first header tank 1*b* at the position higher than the arrangement position of the partition plate 1*k*. Therefore, similarly to the first embodiment, refrigerant flowing from the throttle portion 5 while being turned collides with the refrigerant flowing from the tubes 1*b* between the turning plate 5*a* and the partition plate 1*k*.

In the third embodiment, the throttle portion 5 is constructed by using a cover member 5*c* different from the wall surface of the receiver 2. Further, an opening is provided in an outside wall of the first header tank 1*b*, and the turning plate 5*a* extends from an inner surface of the first header tank 1*b* at the side of the tubes 1*a* to a position around the inner surface of the outside wall of the first header tank 1*b*.

In the third embodiment, the other parts are similar to those of the above-described first embodiment.

(Fourth Embodiment)

Figure 5:
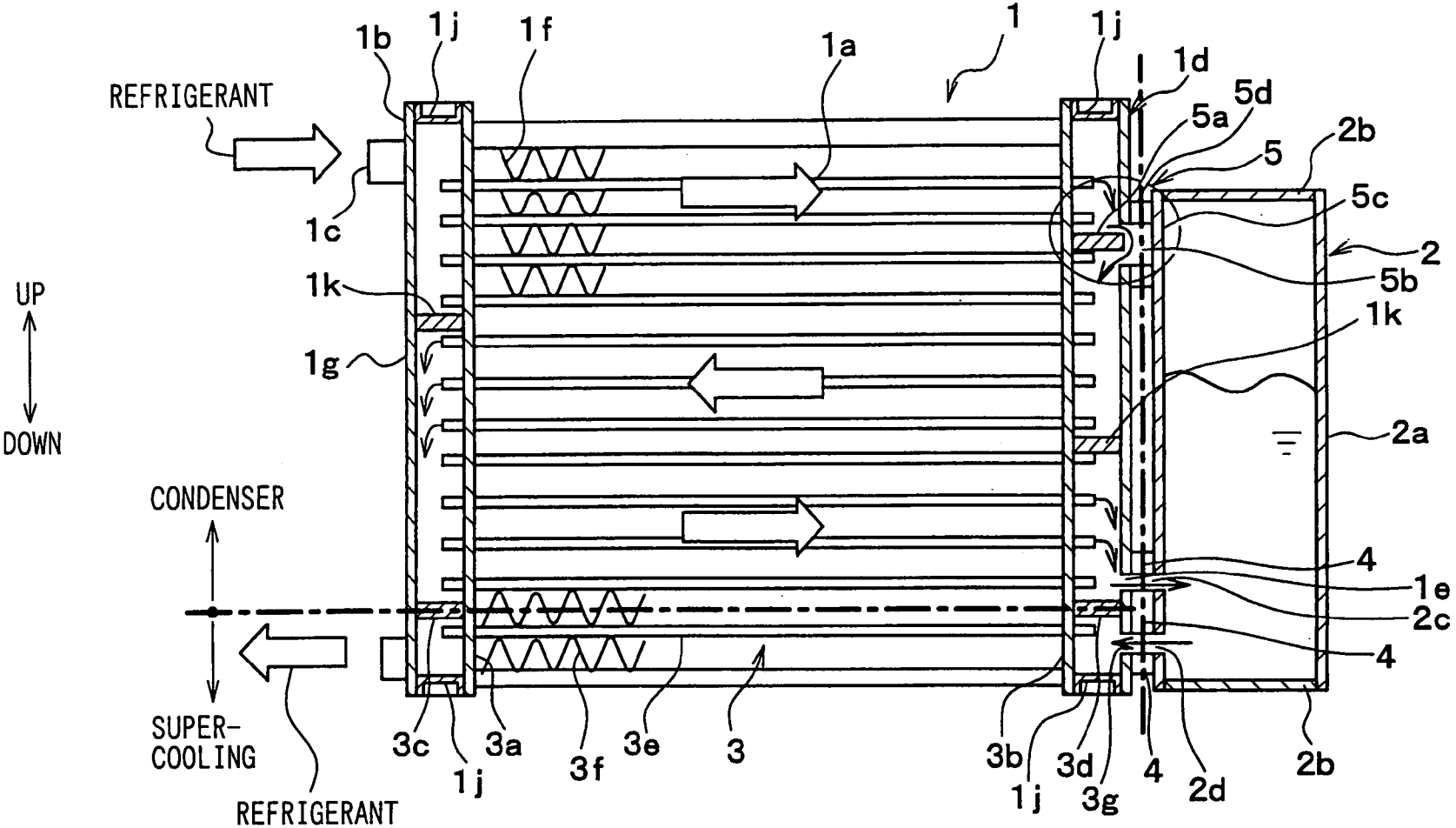
FIG. 5 is a schematic sectional view showing a receiver-integrated condensation device according to a fourth embodiment of the present invention.
Figure 6:
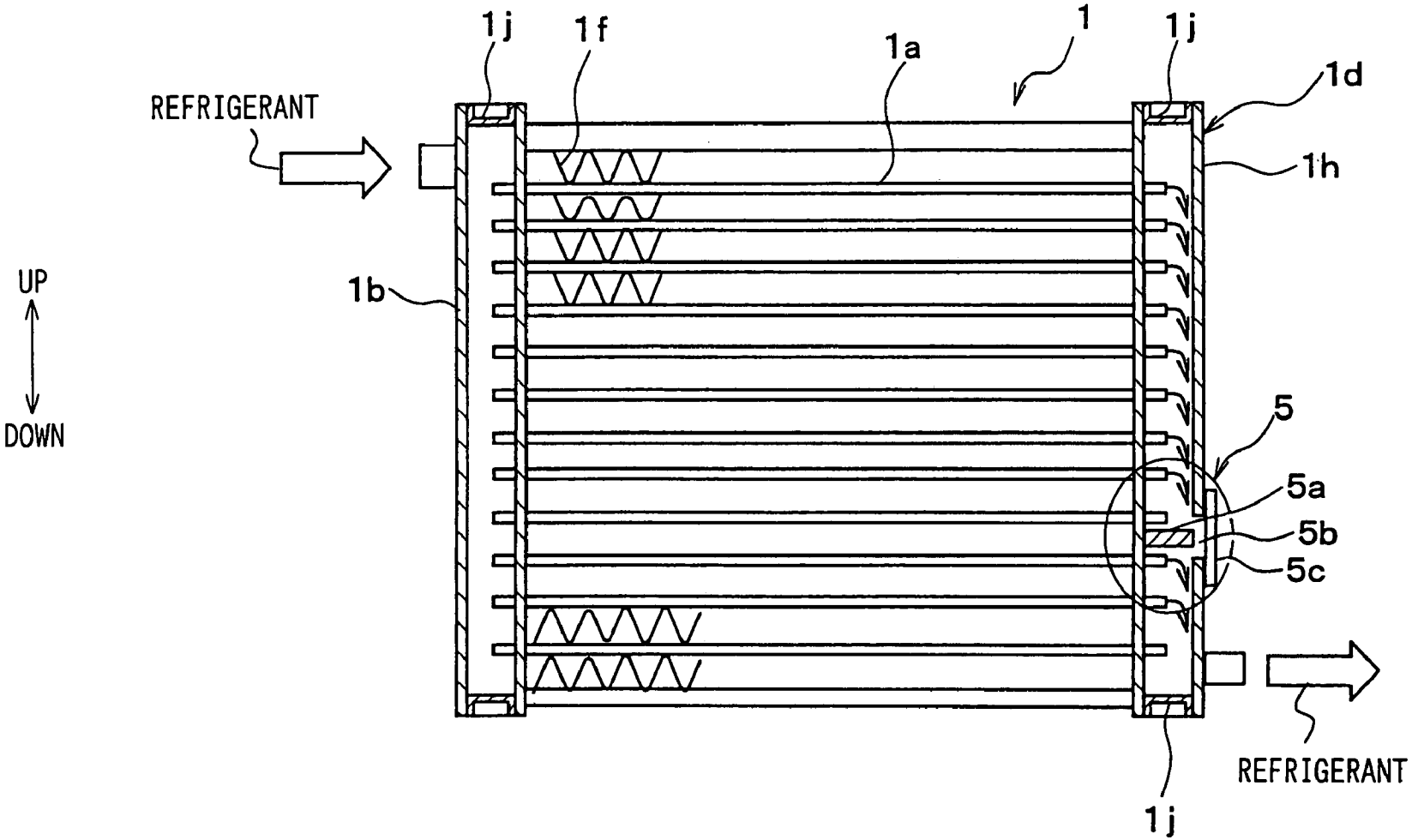
FIG. 6 is a schematic sectional view showing a receiver-integrated condensation device according to a fifth embodiment of the present invention.

In the fourth embodiment, as shown in FIG. 5, a first partition plate 1*k* is disposed in the first header tank 1*b* to partition the inner space of the first header tank 1*b* into upper and lower spaces, and a second partition plate 1*k* is disposed in the second header tank 1*d* to partition the inner space of the second header tank into upper and lower spaces. In addition, the turning plate 5*a* is disposed in the upper space of the second header tank 1*d* at a position upper than the arrangement position of the partition plate 1*k* provided in the first header tank 1*b*. In the fourth embodiment, the other parts are similar to those of the above-described first embodiment.

Accordingly, in the fourth embodiment, refrigerant flows through the condenser 1 meanderingly in an approximate a N-shape when being viewed from the entire flow of the condenser 1.

(Fifth Embodiment)

In the above-described first to fourth embodiments, the present invention is applied to the condenser 1 integrated to the receiver 2 and the super-cooling device 3. However, in the fifth embodiment, the present invention is typically applied to a single structure condenser 1 separated from the other equipment such as the receiver and the super-cooling device. In this case, the opening portion 5*b* provided in the second header tank 1*d* is closed directly by using the cover member 5*c*.

(Sixth Embodiment)

Figure 7:
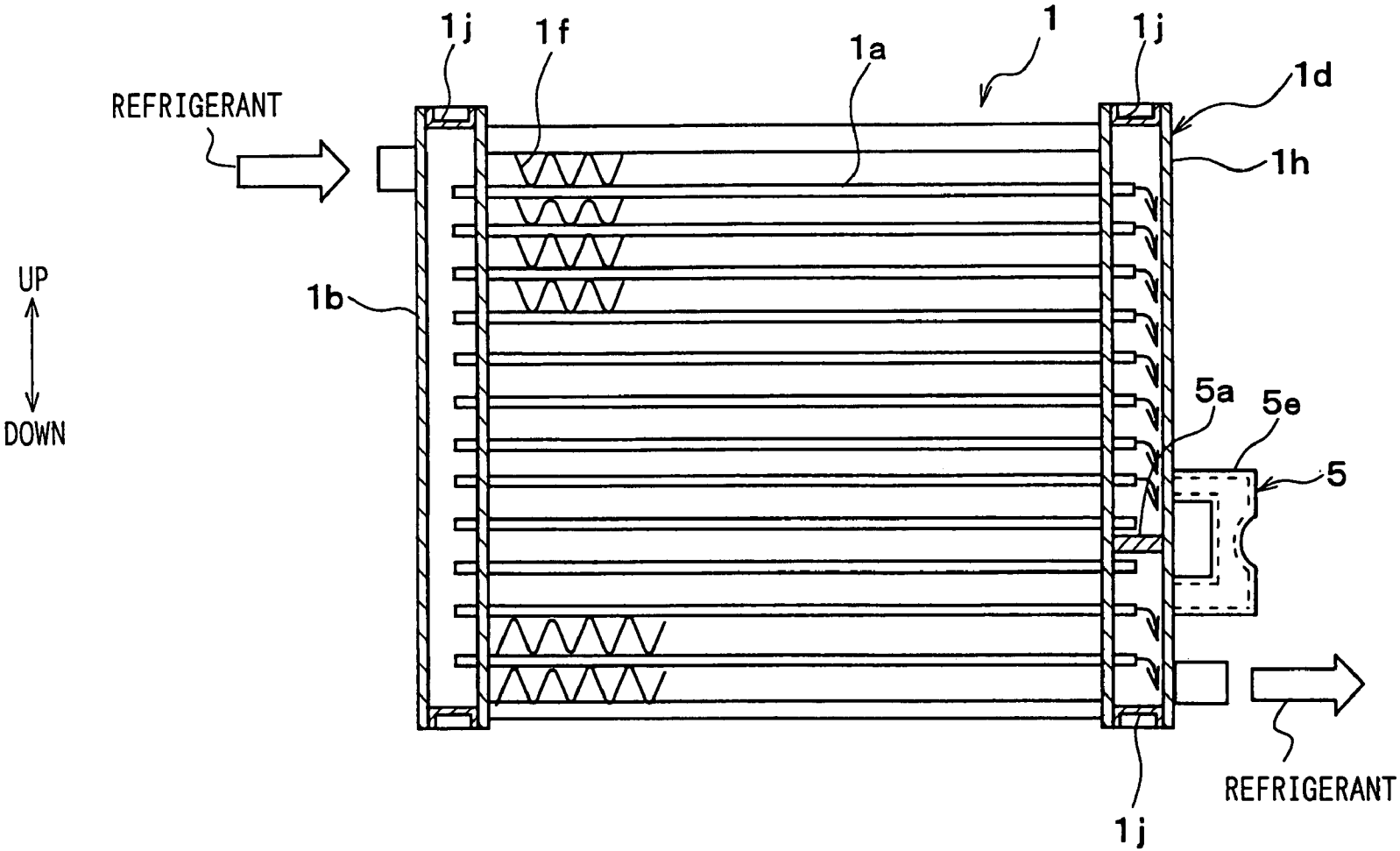
FIG. 7 is a schematic sectional view showing a receiver-integrated condensation device according to a sixth embodiment of the present invention.
Figure 8:
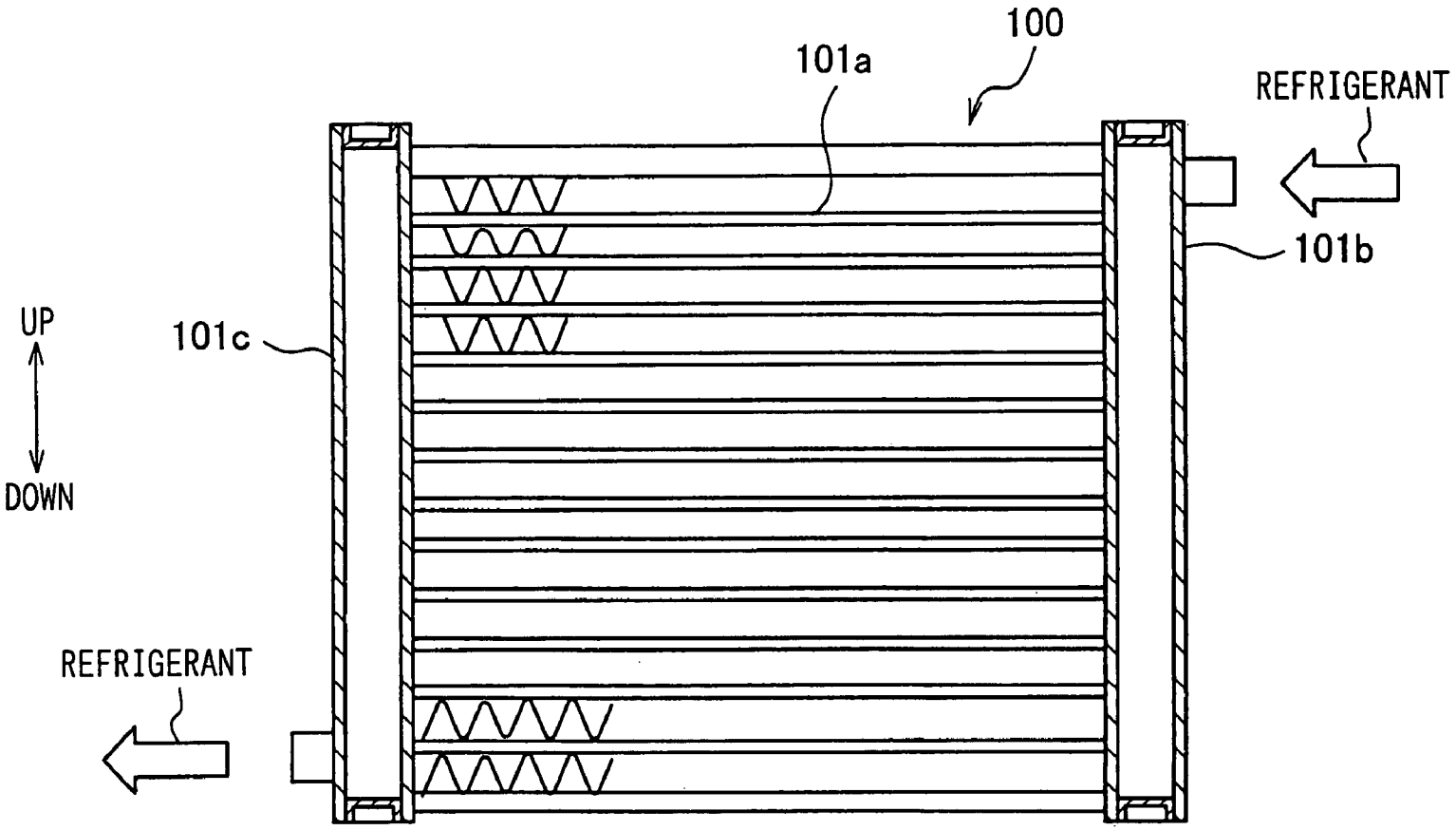
FIG. 8 PRIOR ART
FIG. 8 is a schematic sectional view showing a condenser in a prior art.

In the sixth embodiment, the present invention is applied to a single structure condenser 1, similarly to the above-described fifth embodiment. In the sixth embodiment, as shown in FIG. 7, a partition turning plate 5*a* is disposed in the second header tank 1*d* to partition the inner space of the second header tank 1*d* into an upper space and a lower space. Further, a pipe 5*e* is connected to the second header tank 1*d* at an outside of the second header tank 1*d* so that the upper space communicates with the lower space of the second header tank 1*d* through the pipe 5*e*. Therefore, refrigerant in the upper space of the second header tank 1*d* flows into the pipe 5*e*, and is introduced into the lower space of the second header tank 1*d* while the flow direction of the refrigerant is turned. Accordingly, the refrigerant from the pipe 5*e* flows into the lower space of the second header tank 1*d* mainly in a direction (horizontal direction) crossing with the longitudinal direction of the second header tank 1*d*. Therefore, the refrigerant from the pipe 5e effectively collides with the refrigerant directly flowing from the tubes 1*a* positioned under the pipe 5*e*.

Accordingly, in the sixth embodiment, refrigerant flows in the second header tank 1*d* meanderingly from the upper space to the lower space by the throttle portion 5 while the refrigerant is decompressed in the throttle portion 5.

(Other Embodiment)s

Although the present invention has been fully described in connection with the preferred embodiments thereof with reference to the accompanying drawings, it is to be noted that various changes and modifications will become apparent to those skilled in the art.

For example, in the above-described embodiments, the present invention is typically applied the condenser 1*a* in which the pressure of refrigerant is lower than the critical pressure of the refrigerant and the refrigerant is liquefied and condensed. In this case, freon can be suitably used as the refrigerant, for example. However, the present invention can be applied to a high-pressure heat exchanger (refrigerant radiator) in which the pressure of refrigerant becomes equal to or higher than the critical pressure of the refrigerant. In this case, carbon dioxide can be used as the refrigerant, for example.

Further, the present invention can be applied to a heat exchanger for the other use, without being limited to the condenser of the vehicle air conditioner.

Such changes and modifications are to be understood as being within the scope of the present invention as defined by the appended claims.

What is claimed is:

1. A heat exchanger for a refrigerant cycle, comprising:

a plurality of tubes in which refrigerant flows in a tube longitudinal direction;

a first header tank extending in a direction perpendicular to the tube longitudinal direction to communicate with the tubes at one end side of each tube in the tube longitudinal direction;

a second header tank extending in a direction perpendicular to the longitudinal direction of the tubes to communicate with the tubes at the other end side of each tube in the tube longitudinal direction; and a throttle portion for decompressing refrigerant, the throttle portion being provided at a predetermined position of one of the first and second header tanks, wherein:

the tubes have outlet openings from which the refrigerant flows out, opened into the one of the first and second header tanks;

the throttle portion is located between adjacent outlet openings of the tubes; and the tubes include a first group of tubes having the outlet openings located upstream from the throttle portion and a second group of tubes having the outlet openings located downstream from the throttle portion, the throttle portion has an outlet provided by a hole portion formed on the one of the header tanks at a side opposite to the outlet openings of the second group of tubes.

2. The heat exchanger according to claim 1, wherein:

the first header tank has a refrigerant inlet from which refrigerant is introduced from an exterior; and the throttle portion is provided in the second header tank.

3. The heat exchanger according to claim 1, wherein:

the throttle portion is provided in the second header tank to turn once a flow of the refrigerant flowing in the second header tank to an outside more than an inner surface and further turn the turned flow of the refrigerant to an inside of the second header tank.

4. The heat exchanger according to claim 1, wherein:

the first and second header tanks are arranged to extend in a vertical direction;

the throttle portion is provided In the second header tank at a position higher than a bottom end of the second header tank by a predetermined dimension; and the predetermined dimension is in a range of 1/20–1/3 of a height dimension of the second header tank.

5. The heat exchanger according to claim 4, wherein:

the first header tank has a refrigerant inlet, at a top end side, from which refrigerant is introduced from an exterior;

the second header tank has a refrigerant outlet at a bottom end side of the second header tank; and the first header tank and the second header tank are connected to the tubes such that refrigerant introduced into the first header tank passes through all the tubes and is introduced into the second header tank.

6. The heat exchanger according to claim 1, wherein:

the first header tank has a refrigerant inlet from which refrigerant is introduced from an exterior, at one longitudinal end side of the first header tank;

the second header tank has a refrigerant outlet from which refrigerant is discharged, at one longitudinal end side of the second header tank;

the throttle portion is provided in the second header tank; and each of the first and second header tanks defines therein a single communication apace.

7. The heat exchanger according to claim 1, further comprising a partition plate, disposed in at least one of the first header tank and the second header tank, for partitioning an inner space into plural space parts.

8. The heat exchanger according to claim 1, wherein the first and second header tanks are integrated with a super-cooling device of the refrigerant cycle, for increasing a super-cooling degree of the refrigerant.

9. The heat exchanger according to claim 1, wherein the throttle portion is provided in the second header tank such that refrigerant flows from the throttle portion to a downstream space of the throttle portion in the second header tank mainly in a direction crossing with the longitudinal direction of the second header tank.

10. A heat exchanger for a refrigerant cycle, comprising:

a plurality of tubes in which refrigerant flows in a tube longitudinal direction;

a first header tank extending in a direction perpendicular to the tube longitudinal direction to communicate with the tubes at one end side of each tube in the tube longitudinal direction;

a second header tank extending in a direction perpendicular to the longitudinal direction of the tubes to communicate with the tubes at the other end side of each tube in the tube longitudinal direction; and a throttle portion for decompressing refrigerant, the throttle portion being provided at a predetermined position of one of the first and second header tanks to meanderingly flow the refrigerant within the one of the first and second header tanks in a refrigerant flow of a longitudinal direction of the first and second header tanks; wherein the second header tank includes a tank portion that is connected to the tubes and has a hole portion at a side opposite to the tubes;

the throttle portion is arranged at a position where the hole portion is provided; and the throttle portion is constructed with at least a turning plate having a flat surface crossing with the longitudinal direction of the second header tank, and a cover member for closing the hole portion.

11. The heat exchanger according to claim 10, wherein the turning plate is disposed in the second header tank to continuously extend from an inner surface of a wall portion of the second header tank, connected to the tubes, to at least an Inner surface of a wall portion of the second header tank having the hole portion.

12. The heat exchanger according to claim 10, wherein the turning plate is disposed in the second header tank to continuously extend from an inner surface of a wall portion of the second header tank, connected to the tubes, to a position around an inner surface of a wall portion of the second header tank having the hole portion.

13. The heat exchanger according to claim 10, wherein:

the second header tank is integrated with a receiver of the refrigerant cycle, for separating refrigerant from the heat exchanger into gas refrigerant and liquid refrigerant; and a part of the receiver is used as the cover member.

14. The heat exchanger according to claim 10, wherein the cover member is connected to the hole portion of the second header tank through a connection member that is arranged between the second header tank and the cover member.

15. A receiver-integrated condensation device for a refrigerant cycle, comprising:

a condenser for cooling refrigerant, the condenser including a plurality of tubes in which refrigerant flows in a tubs longitudinal direction, and first end second header tanks disposed at two end sides of each tube to extend in a direction perpendicular to the tube longitudinal direction and to communicate with the tubes;

a receiver for separating refrigerant from the second header tank into gas refrigerant and liquid refrigerant, the receiver being integrated with the second header tank; and a turning plate disposed in the second header tank at a predetermined position to extend in a direction crossing with a longitudinal direction of the second header tank from a first wall surface of the second header tank connected to the tubes toward a second wall surface of the second header tank adjacent to the receiver, wherein:

the second wall surface of the second header tank has a hole portion at a position around the turning plate; and the receiver is disposed to cover the hole portion.

16. The receiver-integrated condensation device according to claim 15, wherein the receiver is directly connected to the second header tank to seal the hole portion.

17. The receiver-integrated condensation device according to claim 15, wherein:

the receiver is connected to the second header tank through a connection member having an opening that communicates with the hole portion of the second header tank; and the receiver is disposed to seal the opening of the connection member.

18. The receiver-integrated condensation device according to claim 15, wherein the turning plate extends in a direction approximately perpendicular to the longitudinal direction of the second header tank, from the first wall surface to at least the second wall surface.

19. The receiver-integrated condensation device according to claim 15, wherein the turning plate extends in a direction approximately perpendicular to the longitudinal direction of the second header tank, from the first wall surface to a position around the second wall surface.

* * * * *